US007828598B2

(12) United States Patent
Wang

(10) Patent No.: US 7,828,598 B2
(45) Date of Patent: Nov. 9, 2010

(54) ELECTRICAL CONNECTOR WITH CLIPS FOR CONNECTING AN OUTER SHELL AND AN INNER SHELL

(75) Inventor: Zhen-Sheng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 14 days.

(21) Appl. No.: 12/387,277

(22) Filed: Apr. 30, 2009

(65) Prior Publication Data

US 2010/0035465 A1 Feb. 11, 2010

(30) Foreign Application Priority Data

Aug. 5, 2008 (CN) ..... 2008 2 0041566

(51) Int. Cl.
*H01R 31/08* (2006.01)

(52) U.S. Cl. ..... 439/607.27

(58) Field of Classification Search ..... 439/541.5, 439/607.01, 607.02, 607.05, 607.06, 607.09, 439/607.17, 607.27
See application file for complete search history.

(56) References Cited

U.S. PATENT DOCUMENTS 6,315,608 B1 * 11/2001 Lopata et al. ..... 439/607.36
6,447,311 B1 * 9/2002 Hu et al. ..... 439/108
6,447,331 B1 9/2002 Hon Hai
7,044,790 B2 * 5/2006 Zhu et al. ..... 439/607.27
7,654,866 B2 * 2/2010 He et al. ..... 439/607.01
2005/0042923 A1 * 2/2005 Zhu et al. ..... 439/607
2010/0022132 A1 * 1/2010 Wang ..... 439/607.27

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector includes a first housing (1) defining a receiving space (11) therethrough. A second housing (2) includes a main body (20) retained in the receiving space (11) of the first housing and a pair of tongue plates (21) projecting to an exterior of the first housing. A plurality of terminals (3) are mounted on the second housing. An inner shell (4) defines a first receiving cavity (41) for receiving said tongue plates (21) therein and a pair of fork shaped locking plates (45,46) extending rearward for locking with protrusion portions (22) formed on the main body (20) of the second housing. An outer shell (5) surrounds the first housing (1). A plurality of clips (7) each includes a first contacting portion (721) contacting with the locking plates of the inner shell (4) and a second contacting portion (731) contacting with the outer shell (5).

12 Claims, 7 Drawing Sheets

ELECTRICAL CONNECTOR WITH CLIPS FOR CONNECTING AN OUTER SHELL AND AN INNER SHELL

BACKGROUND OF THE INVENTION

1. Field of the Invention

The present invention relates to an electrical connector, and particular to an electrical connector having an outer shell and an inner shell.

2. Description of the Related Art

U.S. Pat. No. 7,044,790 discloses an electrical connector having an outer shell and an inner shell. The electrical connector includes an insulating housing having an upper wall, a lower wall and two side walls thereby defining a receiving space for receiving a terminal module therein. The terminal module retained in the receiving space, includes a pair of tongue plates projecting forward and exposing in front of the insulating housing and surrounded by the inner shell. A clip clipped on a top wall of the housing, includes two contacting portions extending rearward to an exterior and inside of the top wall respectively. The inner shell is surrounding the tongue plates and inserted into the receiving space to touch with a lower contacting portion of the clip, and the outer shell is surrounding the insulating housing to touch with an upper contacting portion of the clip, therefore the outer and the inner shells are electrically connected with each other through the clip thereby realizing the grounding function.

The clip is inserted into the top wall of the housing after the terminal module is inserted into the receiving space. As the two contacting portions of the clip extend slantwise outward and oppositely, the lower contacting portion of the clip may abut against a top wall of the tongue plate thereby the assembling process may be interrupted. Moreover, the clip is retained in the upper wall by a lying "n" shaped retaining portion clipping two sides of the recess portion, therefore the retention effect is not steadily and the electrical connection between the outer shell and the inner shell can not be ensured. Hence, an electrical connector which can solve the problem is needed.

SUMMARY OF THE INVENTION

Accordingly, an object of the present invention is to provide an electrical connector with clips connecting an outer shell and an inner shell, wherein the clips are easily assembled and the connecting effect therebetween is pretty good.

In order to achieve the object set forth, an electrical connector includes a first housing defining a receiving space therethrough. A second housing includes a main body retained in the receiving space of the first housing and a pair of tongue plates projecting to an exterior of the first housing. A plurality of terminals are mounted on the second housing. An inner shell defines a first receiving cavity for receiving said tongue plates therein and a pair of fork shaped locking plates extending rearward for locking with protrusion portions formed on the main body of the second housing. An outer shell surrounds the first housing. A plurality of clips each includes a first contacting portion contacting with the locking plates of the inner shell and a second contacting portion contacting with the outer shell.

Other objects, advantages and novel features of the invention will become more apparent from the following detailed description of the present embodiment when taken in conjunction with the accompanying drawings.

DETAILED DESCRIPTION OF THE INVENTION

Figure 1:
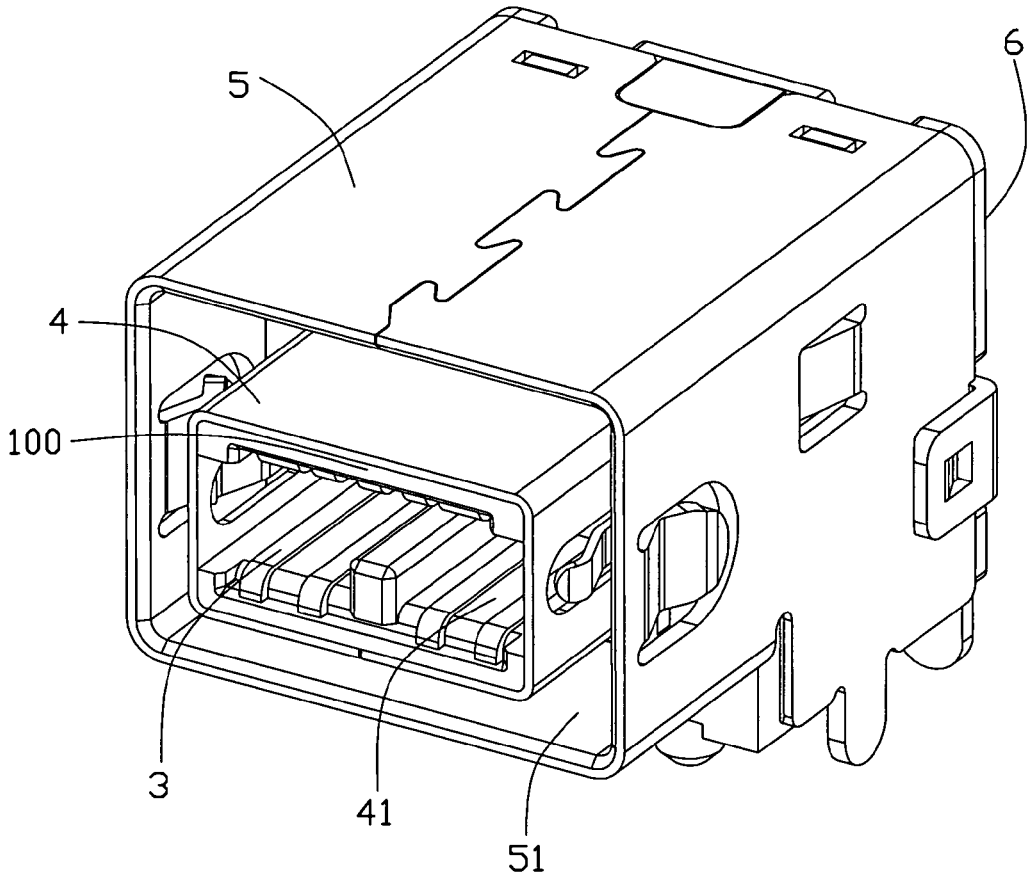
FIG. 1 is a perspective view of an electrical connector in accordance with the present invention.
Figure 2:
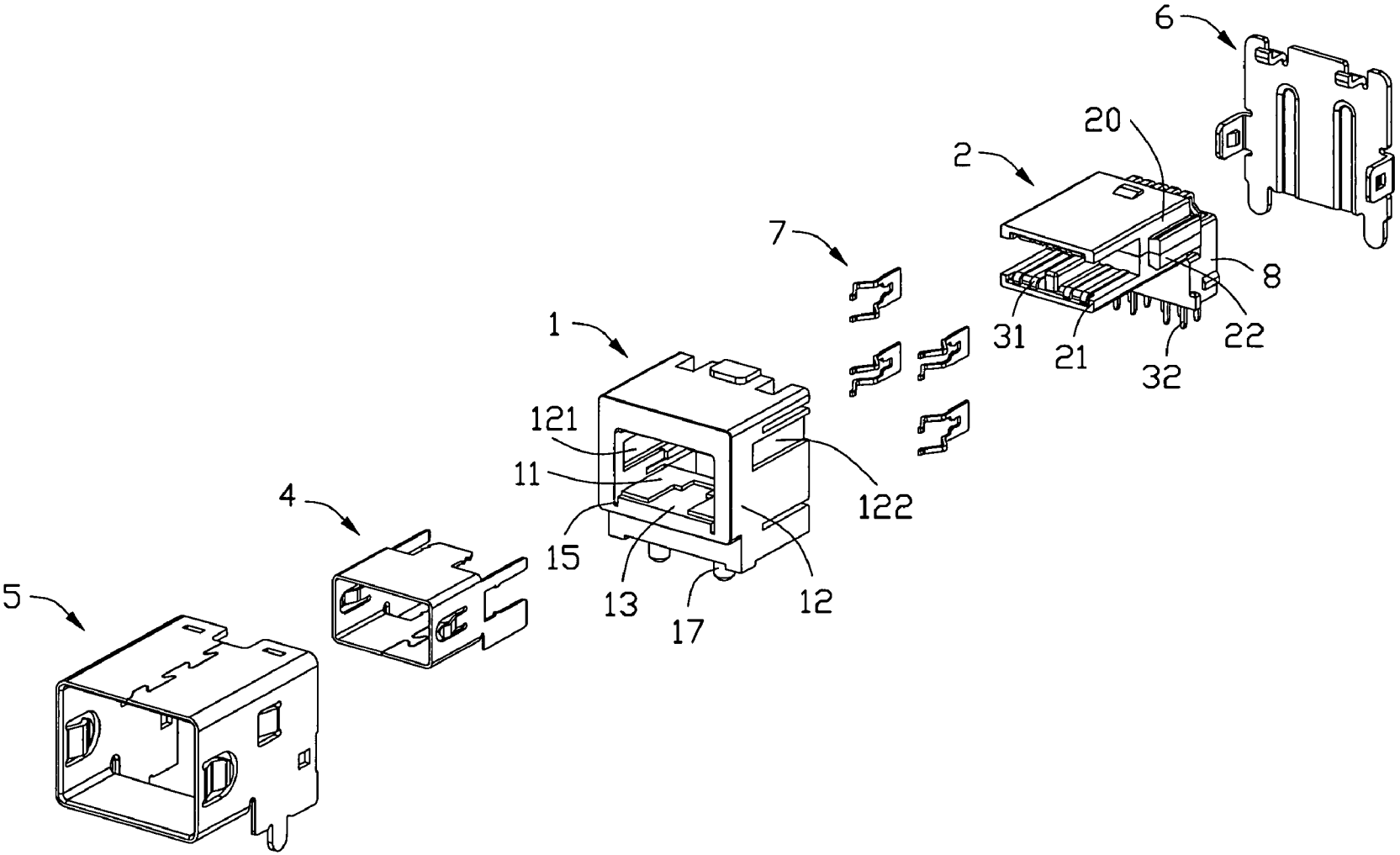
FIG. 2 is an exploded view of the electrical connector shown in FIG. 1.

Reference will now be made to the drawing figures to describe a preferred embodiment of the present invention in detail. Referring to FIGS. 1 and 2, an electrical connector according to the preferred embodiment of the present invention is provided and comprises an insulating housing 100 which includes a first housing 1 and a second housing 2, a plurality of contacts 3 retained in the second housing 1, an inner shell 4 surrounding the second housing 2 and an outer shell 5 surrounding the first housing 1, and a plurality of clips 7 retained in the first housing 1 and contacting with the inner shell 4 and outer shell 5.

Figure 3:
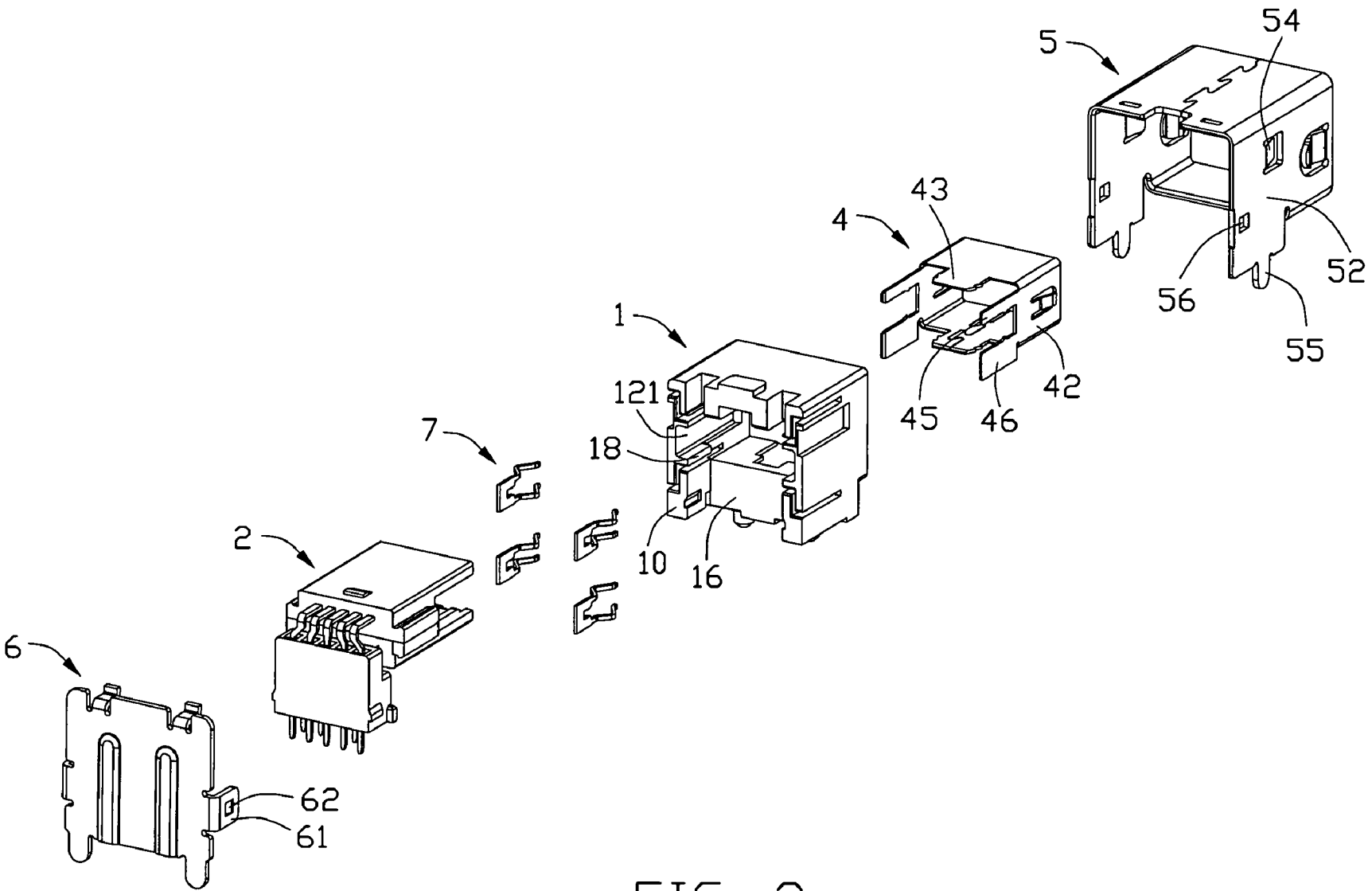
FIG. 3 is another exploded view of the electrical connector shown in FIG. 1.

Referring to FIGS. 2 and 3, the first housing 1 is in a rectangular shape and comprises a top wall, a bottom wall 17 and two side walls 12 connecting the top and bottom walls thereby defining a receiving space 11 running therethrough. A pair of grooves 15 are respectively defined at opposite sides of the bottom wall 17 and extend rearward, and a passageway 121 is defined at a middle portion of an inner side of each side wall 12 and extends forward from a rear face 10 of the first housing 1. A retaining slot 13 is defined on each inner side of the top and bottom walls. A recess portion 16 is defined at a rear end of the first housing 1.

The second housing 2 includes a body portion 20 and a pair of tongue plates 21 extending forward from the body portion and facing to each other. The second housing 2 is inserted into the receiving space 11 from the rear face 10 of the first housing 1, with a pair of protrusions 22 protruding outward from opposite sides of the body portion 20 respectively and retained in the corresponding passageways 121, and the pair of tongue plates 21 projecting to an exterior of the receiving space 11.

Each terminal 3 comprises a contacting portion 31 respectively embedded in inner faces of the two tongue plates 21 and a solder tail 32 extending downward to be retained by a retaining device 8. The retaining device 8 is received in the recess portion 16 of the first housing 1, see FIG. 4.

The inner shell 4 is made by a metal sheet and defines a first receiving cavity 41 surrounded by a pair of side walls 42 and opposite top and bottom walls. The inner shell 4 is assembly on the second housing 2 after the second housing 2 is retained in the first housing 1. An extending plate 43 extends backward from a rear end of each top and bottom walls of the inner shell 4 and is fixed in the corresponding retaining slot 13 in the first housing 1. Moreover, a pair of locking plate 45, 46 form a fork configuration and project backward from a rear edge of each side wall 42 to sandwich the corresponding protrusion 22 therebetween. Hence, the inner shell 4 is surrounding the second housing 2 and retained in the first housing.

The outer shell 5 is also made by a metal sheet and surrounds the first housing 1. The outer shell 5 is assembled to the first housing from a rear-to-back direction, and a locking plate 54 formed at each side wall 52 of the outer shell 5 projects inward to lock with the first housing through a channel 122 defined on an outer side of the side wall 12. Meanwhile, a second receiving cavity 51 is defined at a front portion of the outer shell for receiving the tongue plates 21 together with the inner shell 4 therein. At this time, the inner shell 4 faces to and spaces to the outer shell 5 thereby defining a mating space therein for receiving a mating connector therein. A solder portion 55 extends downward from a bottom edge of each side wall 12 to mount onto a printed circuit board so as to realize grounding function.

Figure 4:
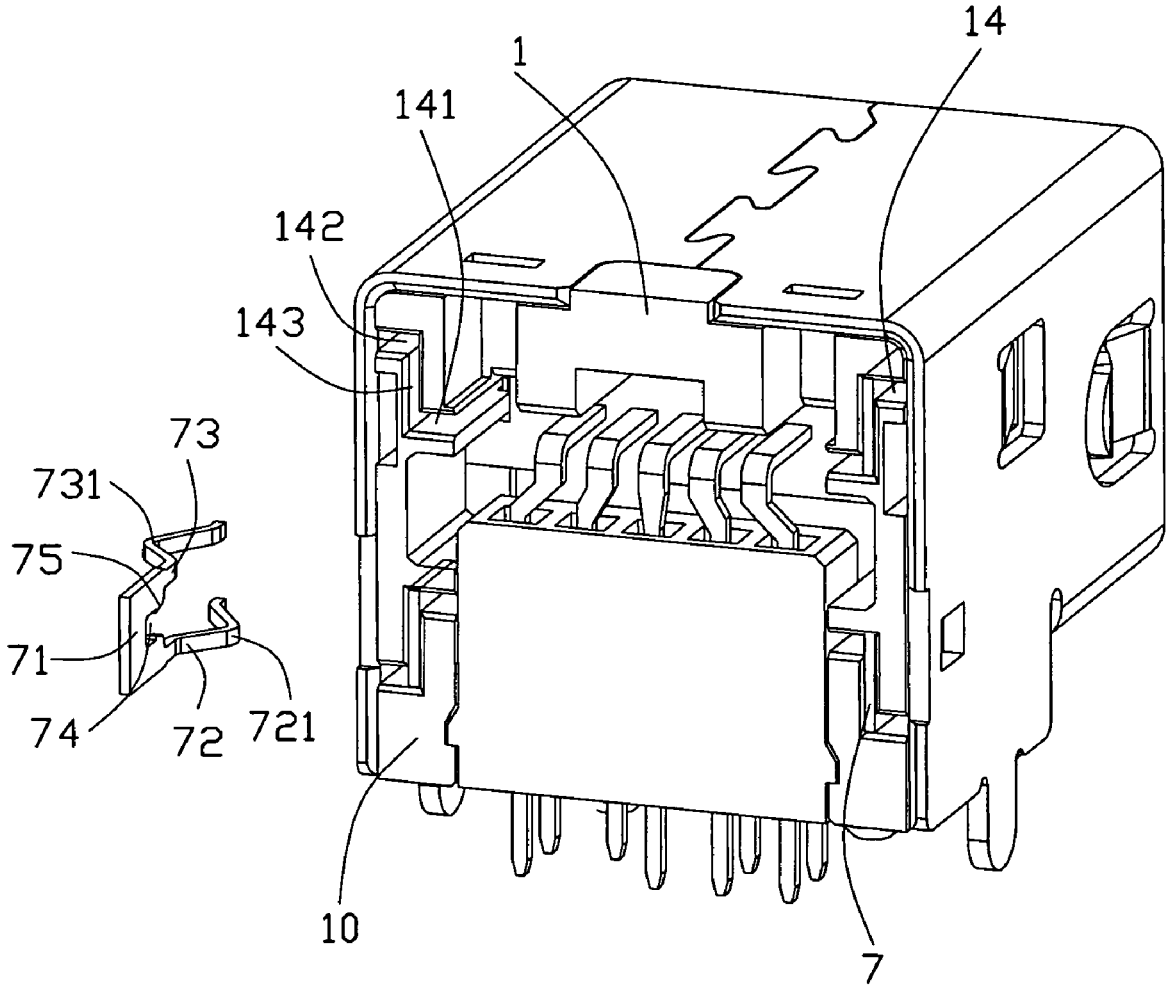
FIG. 4 is a perspective view the electrical connector seen from a rear end, wherein a rear cover is not shown and a clip is drawn out of the electrical connector.
Figure 5:
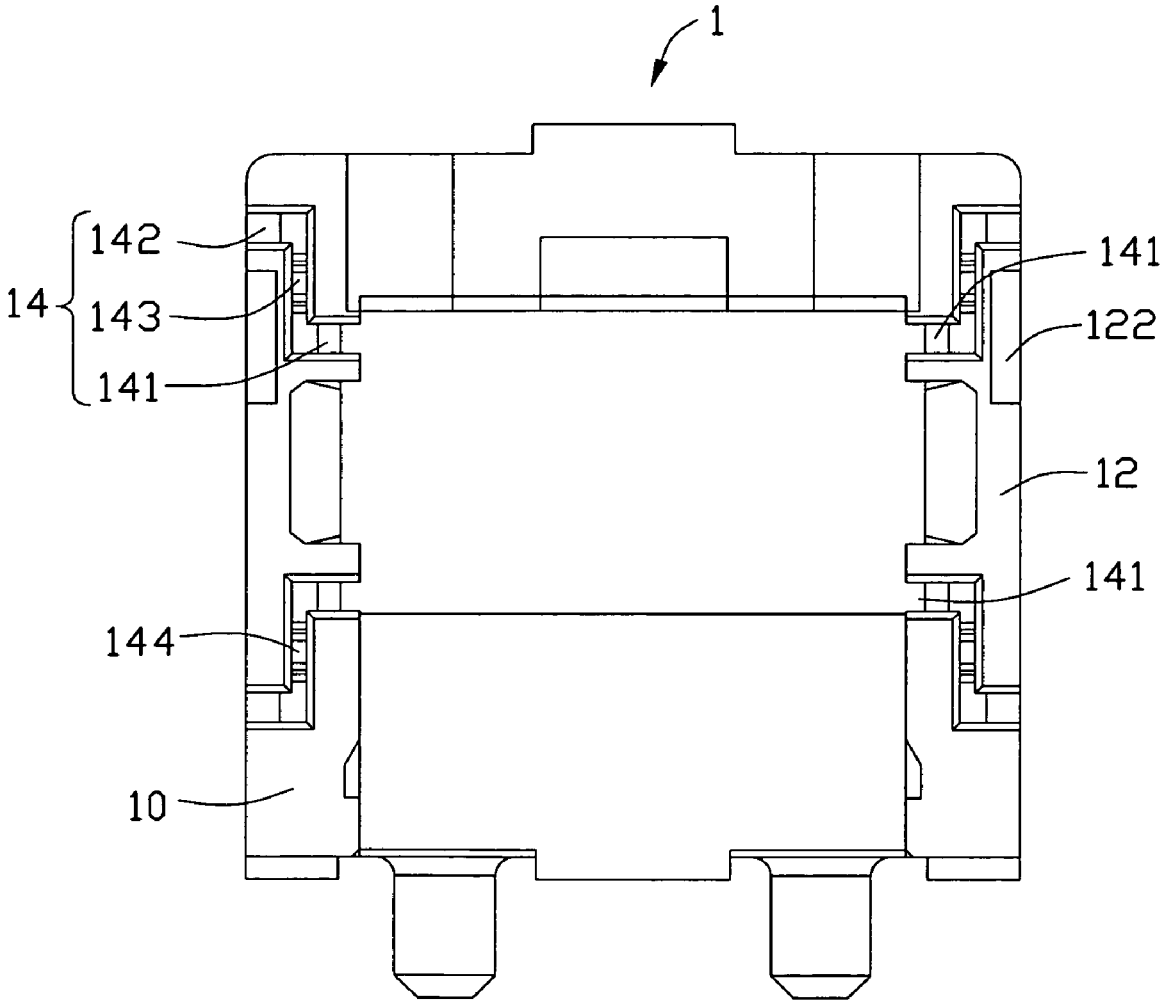
FIG. 5 is a rear view of an insulating housing of the electrical connector shown in FIG. 1.

Referring to FIGS. 4 and 5, each clip 7 is made by a metal sheet and includes a board like main body 71 and a first and a second resilient contacting arms 72, 73 extending forward and spaced to each other from a same edge but opposite sides of the main body 71. A lying "n" shaped aperture 74 is defined at the same edge of the main body 71 and between the first and second resilient contacting arms 72, 73. The first and second resilient contacting arms 72, 73 project outward in a reverse direction thereby defining a first contacting portion 721 and a second contacting portion 731 projecting toward opposite directions relative to the main body 71. That is to say, the first contacting portion 721 locates at an inner side relative to the main body 71, while the second contacting portion 731 locates at an outer side relative to the main body 71. Moreover, a plurality of tips 75 are formed at an inner side of the first and second resilient contacting arms 72, 73.

A pair of passageways 14 located at an upper and a lower corners of each side wall 12 are respectively defined at a rear portion of the side wall 12 and extend forward from a rear face 10 of the housing. Each passageway 14 comprises a vertical passageway 143, a first transverse passageway 141 located at an inner side of a lower edge of the vertical passageway 143, and a second transverse passageway 142 located at an outer side of an upper edge of the vertical passageway 143, therefore the passageway 14 is in a Z shape seen from a rear side of the first housing 1. A rib 144 is formed at a front portion of the vertical passageway 143.

Figure 6:
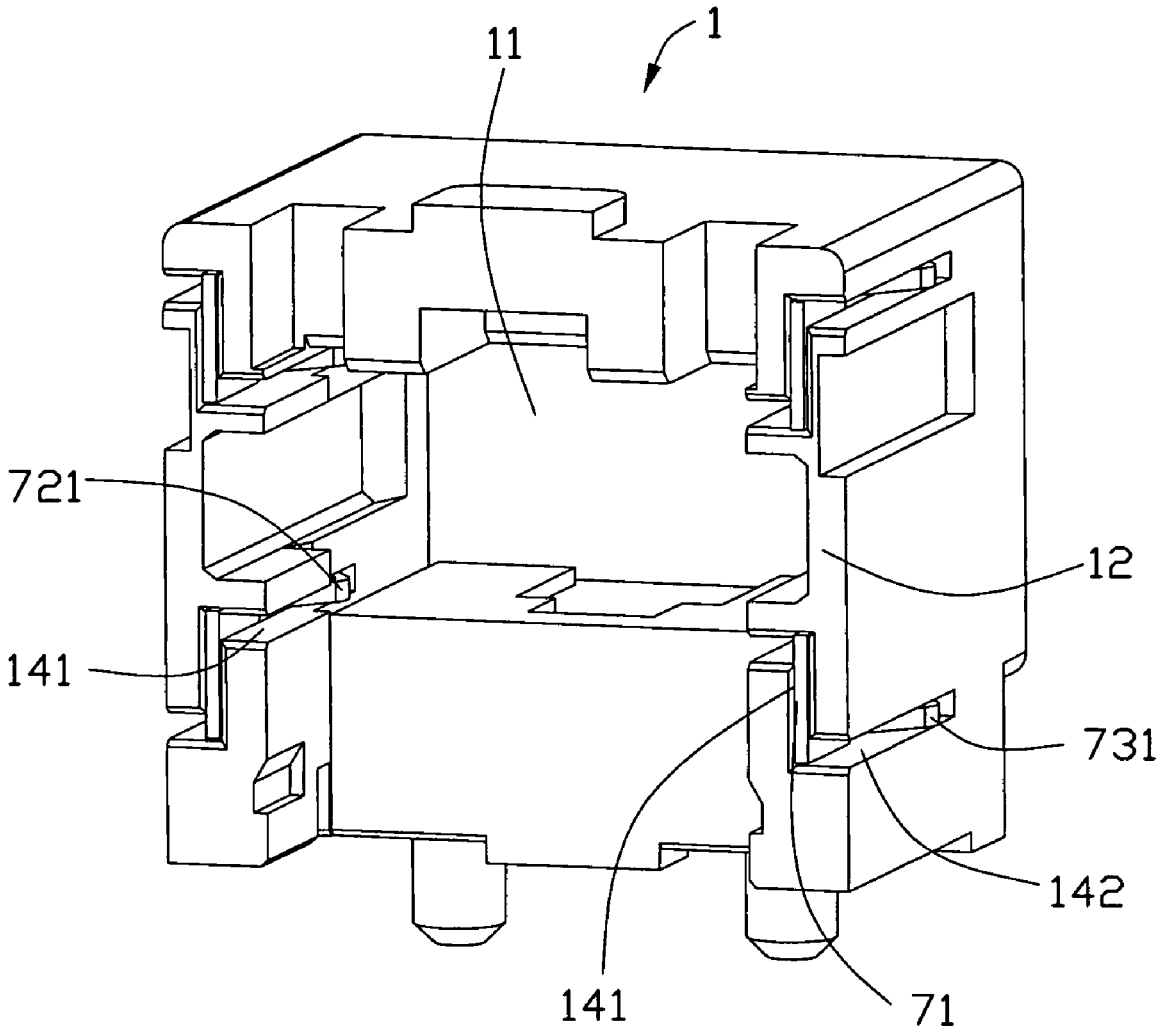
FIG. 6 is a perspective view of the insulating housing seen from the rear end, wherein the clips are inserted into the insulating housing.
Figure 7:
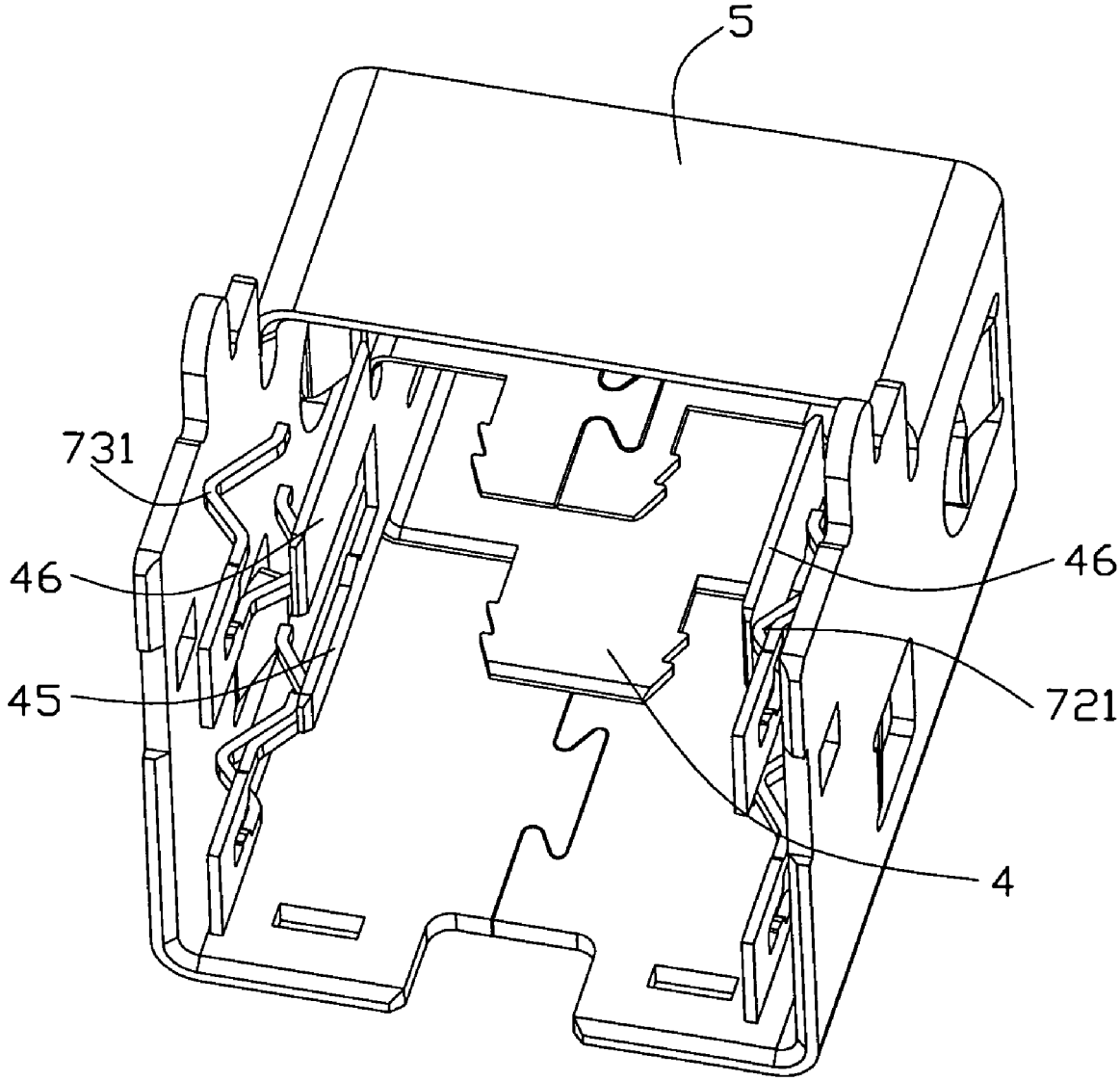
FIG. 7 is a perspective view showing how the clips are connecting with an inner wall and an outer wall of the electrical connector shown in FIG. 1.

Referring to FIGS. 6 and 7, each clip 7 is inserted into the corresponding passageway 14 from the rear face 10 under a condition that the main body 71 is inserted into the vertical passageway 141 until the rib 144 fills up the aperture 74 and the tips 75 abut against the ribs so as to provide a steadily retention for the clip 7. The first and second resilient contacting arms 72, 73 are respectively received in the corresponding first and second transverse passageways 141, 142, with first contacting portion 721 projecting out of the transverse passageway 141 and contacting with the locking plate 45/46 of the inner shell 4, and second contacting portion 731 projecting out of the transverse passageway 142 and contacting with the outer shell 5, therefore the outer shell 5 successfully connects with the inner shell 4 by the plurality of clips 7. Finally, a rear cover 6 which forms a pair of bending plates 61 at opposite sides covers the rear face 10 of the first housing 1 with locking tips 62 on the bending plates 61 bucking with through holes 56 defined on the side wall 52 of the outer shell. When the electrical connector is mounted onto the PCB, both of the outer shell and inner shell can realize the grounding function through the solder portions 55.

As most parts of the clip 7 are embedded in the passageway 14 and just two contacting portions 721, 731 in curved configurations protrude outward of the first housing 1, therefore the clip 7 will not interfere with other parts of the electrical connector and interrupt the assembling process of the electrical connector. Moreover, the electrical connector provide a plurality of clips 7 for connecting with the outer shell 5 an inner shell 4, which can ensure the electrical connecting between the outer shell and inner shell even one of them can not work normally.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first housing defining a receiving space therethrough;

a second housing including a main body retained in the receiving space of the first housing and a pair of tongue plates projecting to an exterior of the first housing;

a plurality of terminals mounted on the second housing;

an inner shell defining a first receiving cavity for receiving said tongue plates therein and a pair of fork shaped locking plates extending rearward for locking with protrusion portions formed on the main body of the second housing;

an outer shell surrounding the first housing; and a plurality of metal clips each comprising a first deflectable contacting portion contacting with the locking plates of the inner shell and a second deflectable contacting portion contacting with the outer shell; wherein said plurality of metal clips are respectively received in vertical passageways defined in side walls of the first housing, and the passageways are in a Z shape seen from a rear side of the first housing;

each of said transverse passageways runs through an inner side and an outer side of said side wall.

2. The electrical connector as described in claim 1, wherein each clip is retained in the first housing under a condition that the first contacting portion exposes to an interior of the first housing, while the second contacting portion exposes to an exterior of the first housing.

3. The electrical connector as described in claim 2, wherein each clip has a main body retained in the first housing, said first and second contacting portions are in curved configurations and project toward opposite directions relative to the main body.

4. The electrical connector as described in claim 3, wherein said first and second contacting portions are respectively formed on first and second resilient contacting arms, the two contacting arms are respectively extending from a same edge but opposite sides of the main body.

5. An electrical connector comprising:

a first housing including an upper wall, a lower wall and two side walls connecting with the upper and lower walls thereby defining a receiving space therethrough;

a second housing including a main body retained in the receiving space and tongue plates projecting forward with a plurality of terminals retained therein;

an outer shell surrounding the first housing;

an inner shell surrounding the second housing; and a plurality of metal clips, each including a main body and a pair of deflectable contacting arms extending reversely relative to the main body to respectively contact with the outer shell and inner shell;

wherein said a plurality of metal clips are received in a vertical passageways defined in the side walls of the first housing, and the passageways are in a Z shape seen from a rear side of the first housing;

each of said transverse passageways runs through an inner side and an outer side of the said side wall.

6. The electrical connector as described in claim 5, wherein said passageway includes the vertical passageway and two transverse passageways located at opposite sides, the main body of the clip is retained in the vertical passageway and the contacting arms are respectively received in the transverse passageways.

7. The electrical connector as described in claim 6, wherein said pair of deflectable contacting arms are located at different levels, respectively.

8. The electrical connector as described in claim 7, wherein a rib is formed in the vertical passageway to fill an aperture defined between the contacting arms of the clip when the clip is inserted into the passageway in a rear-to-front direction.

9. An electrical connector comprising:

a first insulative housing enclosed in a first metallic shell and defining a receiving space;

a second insulative housing enclosed in a second metallic shell, said second insulative housing and the associated second metallic shell commonly received in said receiving space;

a plurality of contacts disposed in a mating port of the second insulative housing;

a Z-like groove, in a rear view, extending forwardly from a rear face of the second housing and including a vertical passageway with a pair of horizontal passageways on two sides thereof; and a metallic clip defining a planar stationary retention section received in the vertical passageway, and a pair of deflectable legs extending from the retention section and into the pair of corresponding passageways to respectively engage the first shell and the second shell;

each of the pair of horizontal passagewa6s of said Z-like groove runs through an inner side and an outer side of a corresponding side wall of the first housing.

10. The electrical connector as claimed in claim 9, wherein a rib is formed in the vertical passageway to be grasped by the retention section.

11. The electrical connector as claimed in claim 9, wherein said pair of deflectable legs are located at different levels, respectively.

12. The electrical connector as claimed in claim 11, wherein the deflectable leg engaged with the second shell, is closer to the mating port than the other deflectable leg.

* * * * *